United States Patent [19]

Pitchford

[11] Patent Number: 5,056,184

[45] Date of Patent: Oct. 15, 1991

[54] BLIND CLEANING RACK APPARATUS

[76] Inventor: George H. Pitchford, 60 Prescott St., Jersey City, N.J. 07304

[21] Appl. No.: 475,238

[22] Filed: Feb. 5, 1990

[51] Int. Cl.[5] ..... A46B 17/02

[52] U.S. Cl. ..... 15/268; 248/166

[58] Field of Search ..... 15/268; 248/166; 211/195

[56] References Cited

U.S. PATENT DOCUMENTS

| | | | |
|---|---|---|---|
| 608,442 | 8/1898 | Cronmiller | 248/166 |
| 1,135,241 | 4/1915 | Woods | 248/166 X |
| 1,509,717 | 9/1924 | Davis | 248/166 X |
| 1,981,268 | 11/1934 | Heiser | 248/166 X |
| 2,588,557 | 3/1952 | Morris et al. | 15/268 X |
| 2,598,798 | 6/1952 | Kerr | 248/166 X |
| 2,634,450 | 4/1953 | Britton | 248/166 X |
| 2,849,745 | 9/1958 | Madsen | 15/268 |
| 2,867,917 | 1/1959 | Carlton | 248/166 X |
| 2,875,971 | 3/1959 | Burns | 15/268 X |
| 2,996,747 | 8/1961 | Lori | 15/268 |
| 3,130,439 | 4/1964 | Bovaird | 15/268 |
| 3,165,847 | 1/1965 | Gunderson | 248/166 X |
| 3,294,251 | 12/1966 | Howell | 248/166 X |
| 4,502,563 | 3/1985 | Pershon | 248/166 X |
| 4,722,500 | 2/1988 | Bray | 248/166 X |

*Primary Examiner*—Paul T. Sewell
*Assistant Examiner*—BethAnne Cicconi
*Attorney, Agent, or Firm*—Leon Gilden

[57] ABSTRACT

An apparatus is set forth including spaced, vertical support members releasably mounted to a top horizontal frame member. Side vertical frame members include stabilizer legs pivotally mounted thereto to secure the organization in a vertical orientation for support of venetian blinds thereon. The top frame member includes a series of orthogonally and fixedly mounted pegs directed forwardly of the frame member to secure a venetian blind arrangement thereon. Plate bars are scissored and secured between the vertical frame members to enable collapsing of the organization when the top frame member is removed therefrom.

1 Claim, 4 Drawing Sheets

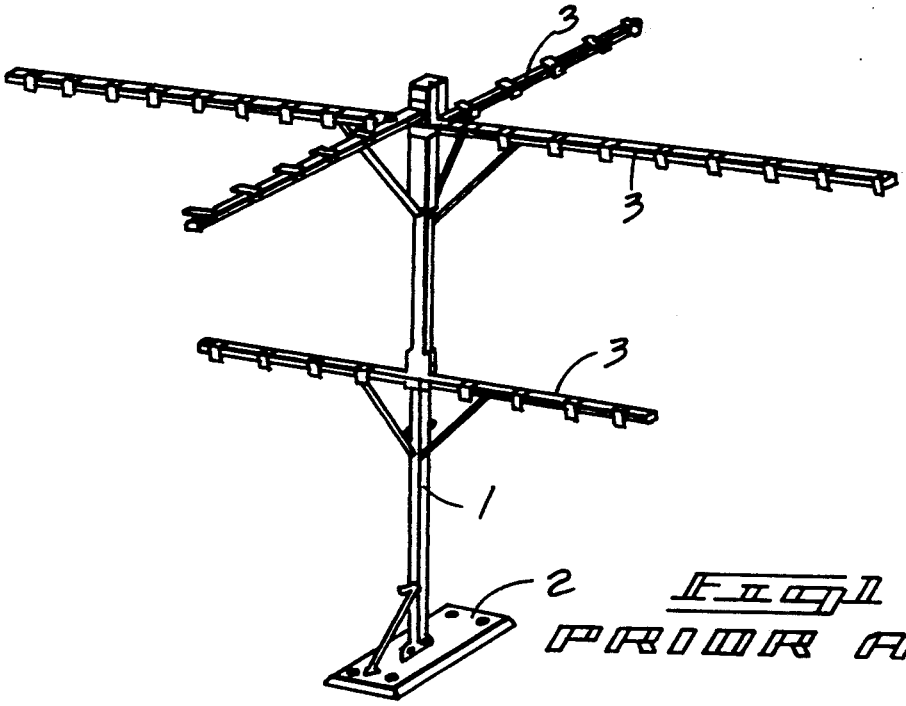
FIG 1
PRIOR ART
FIG 2
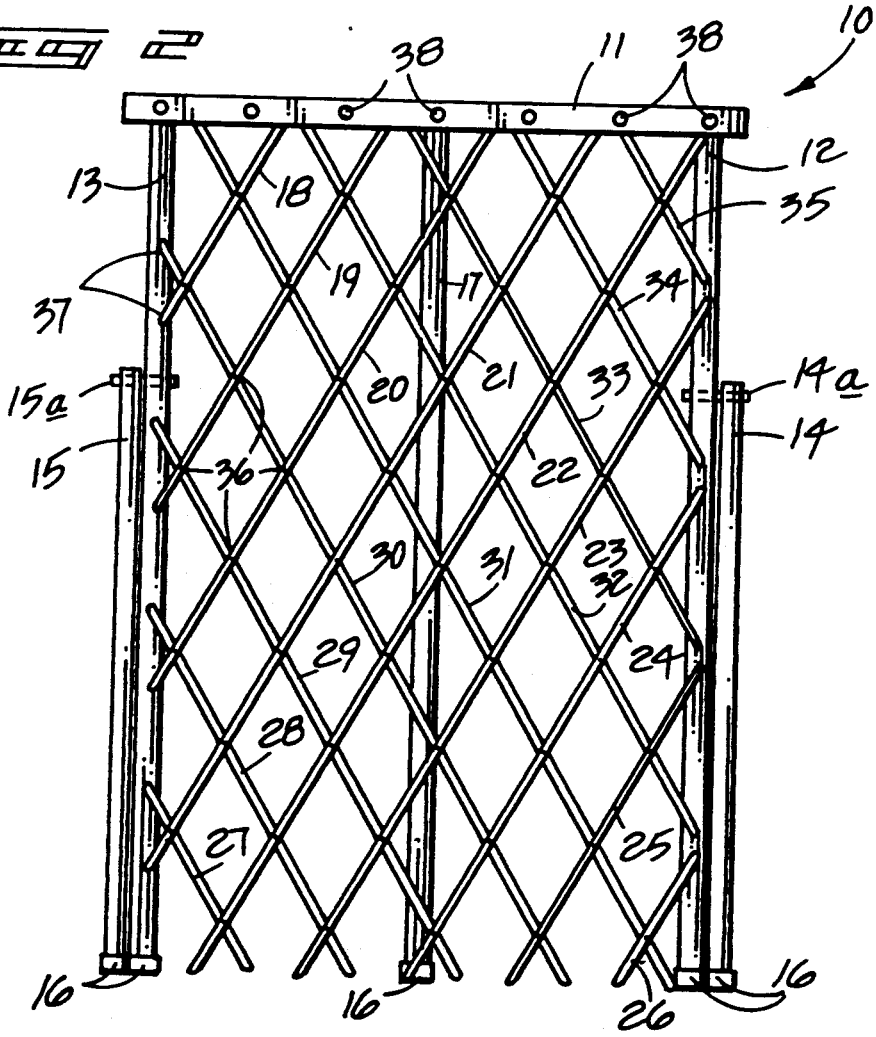

FIG 3
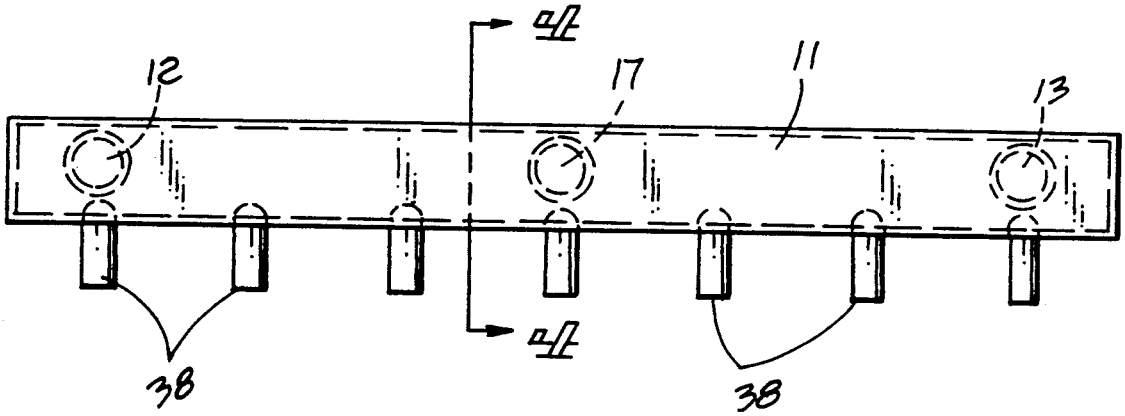
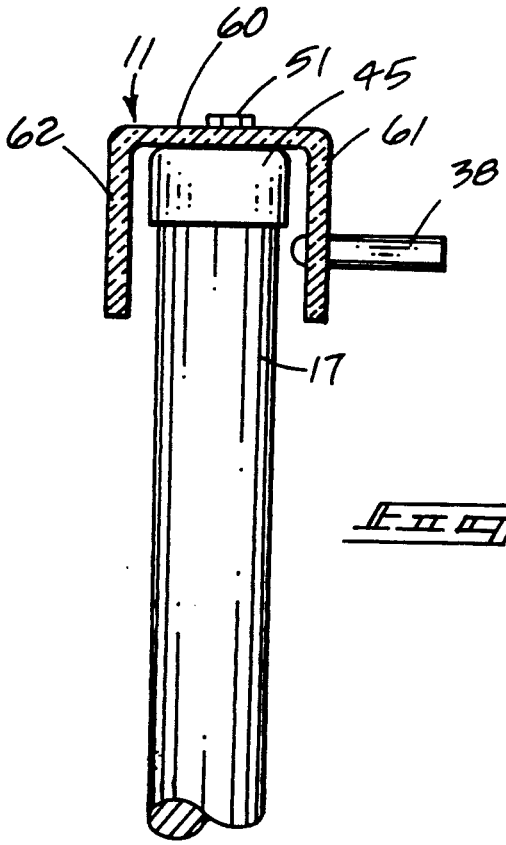
FIG 4

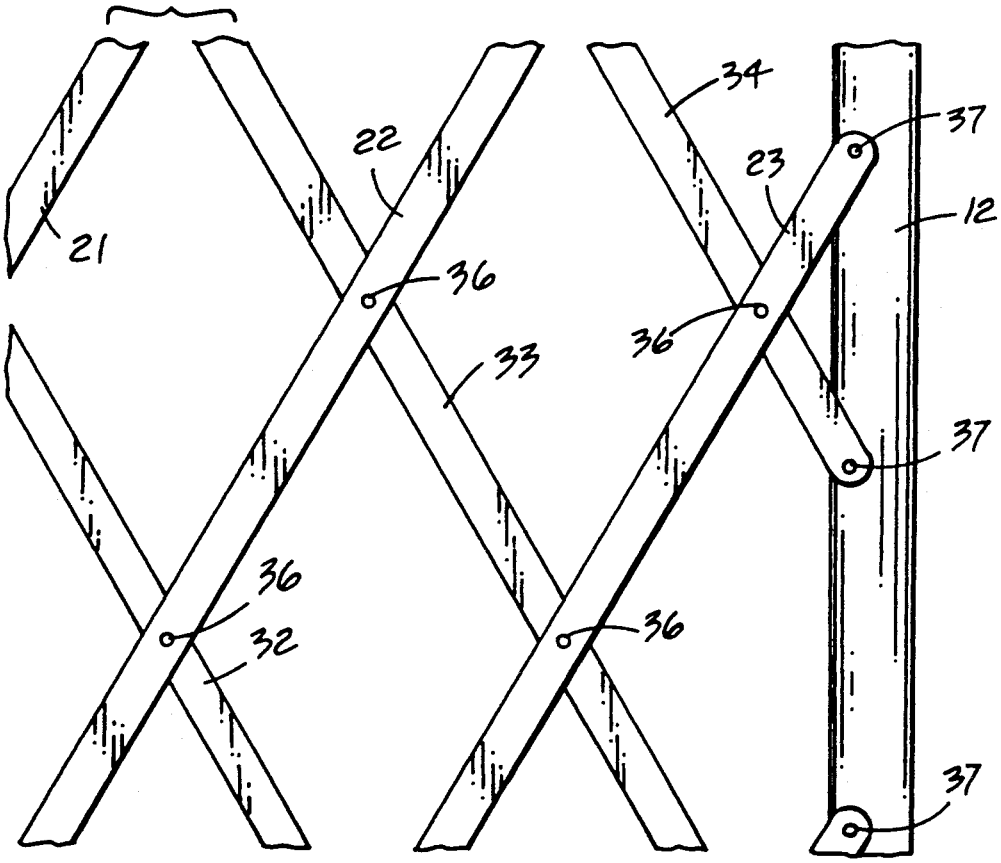
FIG 5
FIG 6
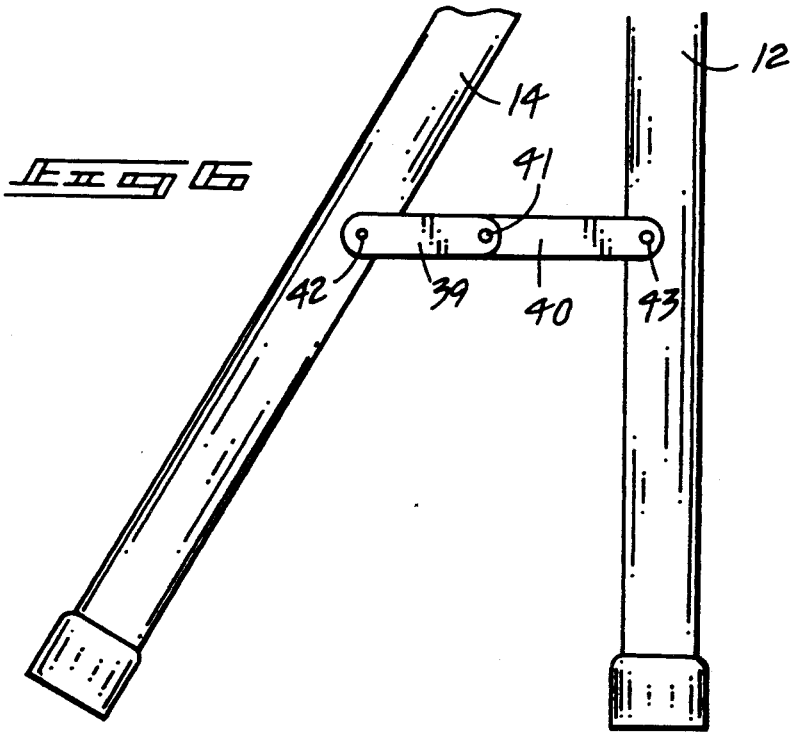

BLIND CLEANING RACK APPARATUS

BACKGROUND OF THE INVENTION

1. Field of the Invention

The field of invention relates to venetian blind cleaning apparatus, and more particularly pertains to a new and improved blind cleaning rack wherein the same is extensible during periods of use and readily compacted for storage thereof.

2. Description of the Prior Art

Venetian blinds are typically of a cumbersome and awkward construction discouraging frequent cleaning of venetian blinds. Various support structures have been utilized in the prior art to support venetian blinds to provide a manner of cleaning them in an extended configuration. Examples of the prior art include U.S. Pat. No. 1,270,156 to Henderson providing a clothes rack that is typically utilized providing a central bar with various support bars fixedly mounted orthogonally relative to the central bar.

U.S. Pat. No. 1,222,805 to Schmidt sets forth a screen construction provided with horizontally interfolded members secured to side rails to enable collapsing of the screen member during periods of non-use.

U.S. Pat. No. 2,851,819 to Weir provides a folding easel utilizing various telescoping and pivoted members to enable collapsing of the easel during periods of non-use.

U.S. Pat. No. 3,967,804 to Kneile provides a frame structure for use in support of tables and the like, wherein the frame structure provides for a collapsing member to support a table top.

U.S. Pat. No. 3,435,570 to Berry provides a structure of a center-like construction to provide an erected platform.

As such, it may be appreciated that there is a continuing need for a new and improved venetian blind cleaning rack wherein the same addresses both the problems of ease of use and effectiveness in construction and in this respect, the present invention substantially fulfills this need.

SUMMARY OF THE INVENTION

In view of the foregoing disadvantages inherent in the known types of support structures now present in the prior art, the present invention provides a blind cleaning rack wherein the same is selectively telescoped to support venetian blinds thereon and alternatively collapsed for storage thereof during periods of non-use. As such, the general purpose of the present invention, which will be described subsequently in greater detail, is to provide a new and improved blind cleaning rack which has all the advantages of the prior art venetian blind support structures and none of the disadvantages.

To attain this, the present invention is set forth including spaced, vertical support members releasably mounted to a top horizontal frame member. Side vertical frame members include stabilizer legs pivotally mounted thereto to secure the organization in a vertical orientation for support of venetian blinds thereon. The top frame member includes a series of orthogonally and fixedly mounted pegs directed forwardly of the frame member to secure a venetian blind arrangement thereon. Plate bars are scissored and secured between the vertical frame members to enable collapsing of the organization when the top frame member is removed therefrom.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especifically the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved venetian blind cleaning rack which has all the advantages of the prior art cleaning racks and none of the disadvantages.

It is another object of the present invention to provide a new and improved venetian blind cleaning rack which may be easily and efficiently manufactured and marketed.

It is a further object of the present invention to provide a new and improved venetian blind cleaning rack which is of a durable and reliable construction.

An even further object of the present invention is to provide a new and improved venetian blind cleaning rack which is susceptible of a low cost of manufacture with regard to both materials and labor, and which accordingly is then susceptible of low prices of sale to the consuming public, thereby making such venetian blind cleaning racks economically available to the buying public.

Still yet another object of the present invention is to provide a new and improved venetian blind cleaning rack which provides in the apparatuses and methods of the prior art some of the advantages thereof, while simultaneously overcoming some of the disadvantages normally associated therewith.

Still another object of the present invention is to provide a new and improved venetian blind cleaning rack wherein the same is selectively extensible and contractible for storage thereof during periods of non-use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a prior art support structure.

FIG. 2 is an orthographic front view taken in elevation of the instant invention.

FIG. 3 is an orthographic top view of the instant invention.

FIG. 4 is an orthographic view taken along the lines 4—4 of FIG. 3 in the direction indicated by the arrows.

FIG. 5 is a sectional view illustrating the lattice bars of the instant invention, the pivotal interconnection and relationship.

FIG. 6 is an orthographic side view taken in elevation illustrating the relationship of a stabilizer leg relative to a side frame leg.

DESCRIPTION OF THE PREFERRED EMBODIMENT

Figure 7:
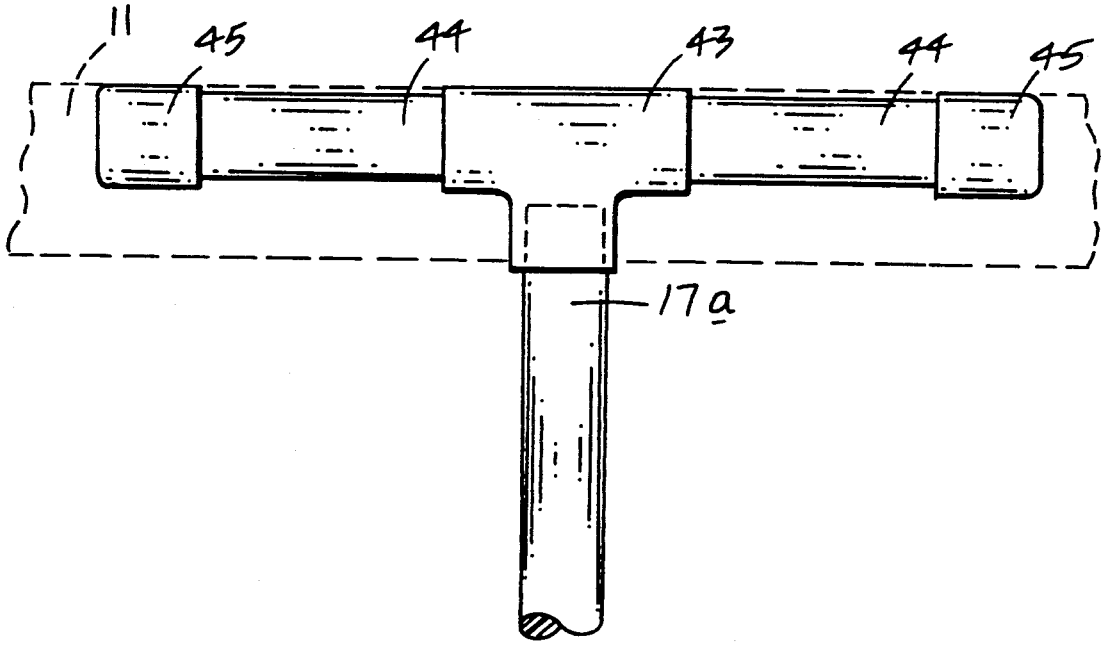
FIG. 7 is an orthographic view taken in elevation of a modified support bar and its relationship to the top frame member.

With reference now to the drawings, and in particular to FIGS. 2 to 8 thereof, a new and improved venetian blind cleaning rack apparatus embodying the principles and concepts of the present invention and generally designated by the reference numeral 10 will be described.

FIG. 1 is illustrative of a typical prior art cleaning rack wherein a vertical bar 1 is mounted at its lowermost end to a base member 2, including a series of horizontal bars 3 integrally and orthogonally secured to the vertical bar 1. The venetian blind apparatus has been typically draped over such horizontal bars 3 for support during a cleaning procedure.

More specifically, the blind cleaning rack apparatus 10 of the instant invention essentially comprises a top horizontal frame member 11 defined as a generally "C" shaped channel defined by a horizontal frame plate 60 having mounted thereto forward 61 and rear 62 vertical frame plate coextensive therewith and a horizontal frame plate having secured thereto a right frame leg 12 and a left frame leg 13 releasably mounted adjacent respective right and left ends of the horizontal frame member 11. A right stabilizer leg 14 and a left stabilizer leg 15 utilize respective first and second pivot connections **14*a* and 15*a* to pivotally mount the respective stabilizer leg to an associated frame leg, as illustrated in FIG. 2. Resilient end caps 16 are integrally and fixedly mounted to lower terminal ends of the leg members 11, 12, 13, 14, as well as to a central support leg 17 mounted medially of the top frame member 11. The leg members 12, 13, and 17** are arranged parallel relative to one another in an assembled configuration, as illustrated in FIG. 2.

A matrix of planar lattice bars are pivotally mounted to each other and to the right and left frame legs 12 and 13 to provide a collapsible construction when the right and left leg members are removed from the top frame member 11. The removal of a top frame member 11 enables a collapsing of the lattice bars as the right and left frame legs 12 and 13 are directed towards one another to collapse the structure once removed from the top frame member 11. The lattice bars comprise a respective first lattice bar 18, second lattice bar 19, third lattice bar 20, fourth lattice bar 21, fifth lattice bar 22, sixth lattice bar 23, seventh lattice 24, eighth lattice 25, and ninth lattice bar 26, each arranged parallel relative to one another and intersecting further lattice bars defined by the first further lattice bar 27, further second lattice bar 28, further third lattice bar 29, further fourth lattice bar 30, further fifth lattice bar 31, further sixth lattice 32, further seventh lattice bar 33, further eighth lattice bar 34, and further ninth lattice bar 35. The lattice bars are pivoted relative to one another by bar pivots 36 at their junctions of intersection, with the lattice bars pivotally mounted by frame pivots 37 to the respective right and left frame members 12 and 13.

Extending orthogonally forwardly of a forward leg of the "C" shaped top frame member 11, as illustrated in FIG. 4, are a series of parallel and equally spaced support pegs 38 extending forwardly of a forward leg of the top frame member. The support pegs 38 are preferably formed of a relatively rigid polymeric material to avoid marring of an associated venetian blind arrangement mounted thereon.

The left and right stabilizer legs 14 and 15 respectively are mounted at their upper ends by respective pivot connections **14*a* and 15*a*, as noted above, and are linked medially of their length to a respective frame leg member by a first and second link 39 and 40, wherein the first and second links are pivotally secured together by a central pivot 41 and mounted to the respective stabilizer leg and frame leg by end pivots 42** to limit pivotment of the stabilizer legs relative to a frame leg, as illustrated in FIG. 6 for example.

The vertical leg members each include a cap member 45 that is fixedly mounted to the associated horizontal frame member 11, wherein the vertical frame members are slidably removable from the cap members 45. The cap members 45 are preferably formed of a resilient, polymeric material to frequently engage the upper ends of the vertical frame members when inserted therewithin, as illustrated for example in FIG. 4. The cap members 45 are in turn selectively secured to the top frame member 11 by adhesives or by a fastener 51, as illustrated in FIG. 4.

FIG. 7 illustrates a modified securement of the vertical frame members wherein a modified central support 17 for example is slidably received within a center junction 43 that in turn receives horizontal end rods 44 therewithin that are in turn secured to the cap members 45. The illustration of FIG. 7 is typical and as understood, may be utilized for each of the vertical frame members comprising the right, left, and central frame portions 12, 13, and 17 in a like manner. The central junction 43 is also preferably formed of at least a resilient liner to frictionally secure the respective vertical frame member mounted slidably therewithin.

Figure 8:
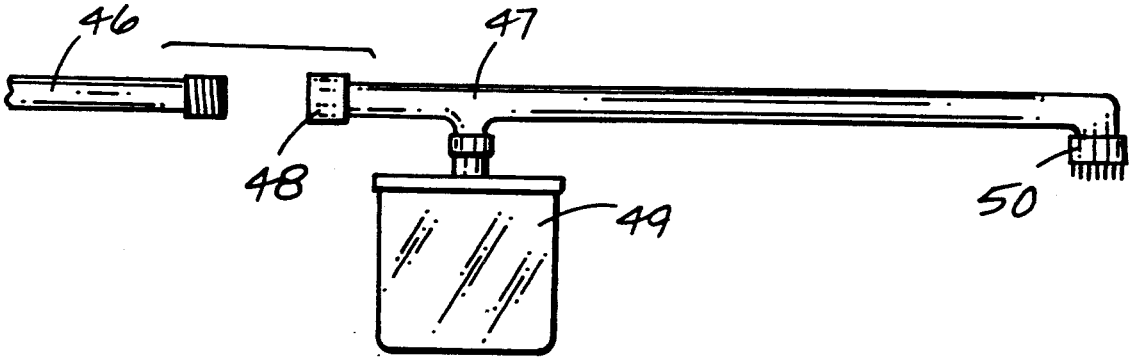
FIG. 8 is an orthographic view taken in elevation of a cleaning member utilized in association with the rack of the instant invention.

FIG. 8 illustrates a cleaning organization utilized by the instant invention wherein a water hose 46 is secured to a central rigid conduit 47 by an end connector 48. The central conduit 47 includes a detergent canister 49 mounted adjacent the connector 48 at a rear end thereof to provide balance to the organization, wherein the conduit 47 is directed forwardly with an orthogonally mounted brush head 50 formed to a forwardmost end of the conduit 47 to enable cleaning of an associated venetian blind assembly when mounted on the apparatus 10.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A cleaning rack apparatus for mounting and cleaning a venetian blind assembly thereon, wherein the apparatus comprises, a top horizontal frame member, including a horizontal frame plate orthogonally mounted to a vertical frame plate, and a right vertical frame leg slidably detachably and orthogonally mounted to the horizontal frame plate, adjacent a right end of the horizontal frame member, and a left vertical frame leg slidably detachably and orthogonally mounted to the horizontal frame plate adjacent the left end of the horizontal frame member, and means detachably mounting right and left frame caps to said horizontal frame plate, and a series of pegs integrally and orthogonally mounted to the vertical frame plate and extending outwardly thereof, and a lattice matrix of planar bars pivotally mounted to each other, with selective ones of the bars pivotally mounted to the right and left vertical frame legs to enable collapse of the rack apparatus when the top horizontal frame member is removed from the right and left frame legs, and further including a central support member orthogonally and detachably mounted to the horizontal frame plate to provide stability thereto, and further including a right and left stabilizer leg pivotally mounted to a respective right and left vertical frame leg at respective upper ends of the right and left stabilizer legs, and the stabilizer legs including plural link members, the plural link members pivotally mounted to each respective right and left stabilizer leg medially thereof at one end and to the respective right and left vertical frame leg at the other end of the link member, and means detachably mounting a central frame cap to said horizontal frame plate, and wherein the matrix of planar bars include a first series of bars arranged parallel to one another, and a second series of bars, wherein the second series of bars are arranged parallel to one another, the first and second series of bars intersecting each other, and each of the intersections defining a pivotal connection, and wherein the right vertical frame leg, the left vertical frame leg and the central frame leg are respectively defined by a right, left, and central upper end, each upper end frictionally and slidably received within a resilient cap defining said means for detachably mounting said legs each resilient cap fixedly mounted to the horizontal frame plate, and further including a cleaning assembly, wherein the cleaning assembly comprises a central, elongate, rigid conduit formed with a connector at a rearward end thereof, and a brush head at a forward end thereof, the brush head orthogonally mounted to the central rigid conduit and in fluid communication therewith, and a detergent canister mounted to the central rigid conduit adjacent the connector.

* * * * *